US010253766B2

(12) United States Patent
Lifson et al.

(10) Patent No.: US 10,253,766 B2
(45) Date of Patent: Apr. 9, 2019

(54) ECONOMIZED RECIPROCATING COMPRESSOR

(71) Applicant: Carrier Corporation, Jupiter, FL (US)

(72) Inventors: Alexander Lifson, Manlius, NY (US); Paul J. Flanigan, Cicero, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 15/566,753

(22) PCT Filed: May 9, 2016

(86) PCT No.: PCT/US2016/031449

§ 371 (c)(1),
(2) Date: Oct. 16, 2017

(87) PCT Pub. No.: WO2016/182998

PCT Pub. Date: Nov. 17, 2016

(65) Prior Publication Data

US 2018/0128254 A1 May 10, 2018

Related U.S. Application Data

(60) Provisional application No. 62/160,803, filed on May 13, 2015.

(51) Int. Cl.
*F04B 39/12* (2006.01)
*F04B 25/00* (2006.01)
(Continued)

(52) U.S. Cl.
CPC ..... *F04B 39/125* (2013.01); *F04B 25/00* (2013.01); *F25B 1/02* (2013.01); *F25B 1/10* (2013.01);
(Continued)

(58) Field of Classification Search
CPC ..... F04B 25/00; F04B 39/125; F04B 2201/0807; F25B 1/02; F25B 1/10;
(Continued)

(56) References Cited

U.S. PATENT DOCUMENTS 4,326,839 A 4/1982 Fry et al.
5,238,370 A 8/1993 DiFlora
(Continued)

FOREIGN PATENT DOCUMENTS

EP 0845642 A2 6/1998
EP 1041285 A2 10/2000
(Continued)

OTHER PUBLICATIONS

International Search Report and Written Opinion dated Aug. 3, 2016 for PCT Patent Application No. PCT/US2016/031449.
(Continued)

*Primary Examiner* — Marc E Norman
(74) *Attorney, Agent, or Firm* — Bachman & LaPointe, P.C.

(57) ABSTRACT

A compressor (22) has: a case (32) defining: a first cylinder bank (70) having a plurality of cylinders (76, 77); a cylinder head (100); a suction port (26); a discharge port (28); and an economizer port (30); a plurality of pistons, each individually associated with a respective one of the cylinders; and a crankshaft (202) held by the case for rotation about a crankshaft axis and coupled to the pistons. The first cylinder bank cylinder head is divided into: a first suction chamber (130); a second suction chamber (132); and a single discharge chamber (128). The first cylinder bank first suction chamber is coupled to the suction port. The first cylinder bank second suction chamber is coupled to the economizer port. The first cylinder bank discharge chamber is coupled to the discharge port.

18 Claims, 5 Drawing Sheets

(51) Int. Cl.

| | |
|---|---|
| ***F25B 1/02*** | (2006.01) |
| ***F25B 1/10*** | (2006.01) |
| ***F25B 9/00*** | (2006.01) |
| ***F25B 31/02*** | (2006.01) |

(52) U.S. Cl.
CPC ..... *F25B 9/002* (2013.01); *F25B 31/023* (2013.01); *F04B 2201/0807* (2013.01); *F25B 2400/074* (2013.01); *F25B 2400/13* (2013.01)

(58) Field of Classification Search
CPC .. F25B 9/002; F25B 31/023; F25B 2400/074; F25B 2400/13
See application file for complete search history.

(56) References Cited

U.S. PATENT DOCUMENTS

| | | | |
|---|---|---|---|
| 5,722,818 | A | 3/1998 | Ohta et al. |
| 5,860,800 | A | 1/1999 | Kramer et al. |
| 6,568,921 | B2 | 5/2003 | Dittrich |
| 2005/0198997 | A1 | 9/2005 | Bush |
| 2011/0171044 | A1 | 7/2011 | Flanigan |
| 2014/0363322 | A1 | 12/2014 | Junior et al. |
| 2016/0245278 | A1* | 8/2016 | Bergman ..... F04B 7/0057 |
| 2017/0343244 | A1* | 11/2017 | Ascani ..... F25B 1/02 |

FOREIGN PATENT DOCUMENTS

| | | | |
|---|---|---|---|
| EP | 1722173 | A2 | 11/2006 |
| GB | 2427660 | B | 12/2010 |
| JP | 2005042624 | A | 2/2005 |
| WO | 2010/133503 | A1 | 11/2010 |
| WO | 2011/084369 | A2 | 7/2011 |
| WO | 2013/182408 | A1 | 12/2013 |
| WO | 2014/072131 | A1 | 5/2014 |

OTHER PUBLICATIONS

TECH Service Training, 06D, 06E Compressor, 1990, Rev. Jul. 1992, pp. 7-15, Carrier Corporation, Syracuse, New York.

06D/E Application Guide, Jul. 1995, Rev. Aug. 1998, Carlyle Compressor Company, Carrier Corporation, Syracuse, New York.

* cited by examiner

ECONOMIZED RECIPROCATING COMPRESSOR

CROSS-REFERENCE TO RELATED APPLICATION

Benefit is claimed of U.S. Patent Application No. 62/160,803, filed May 13, 2015, and entitled "Economized Reciprocating Compressor", the disclosure of which is incorporated by reference herein in its entirety as if set forth at length.

BACKGROUND

The disclosure relates to vapor compression systems. More particularly, the disclosure relates to economized reciprocating compressors.

Various economized reciprocating compressors have been proposed. In one example, there is staged compression with the main flow of refrigerant passing sequentially through two stages of cylinders and the economizer flow being introduced at the interstage. This multi-stage compression introduces additional valve flow losses and friction (because the refrigerant flow from the evaporator needs to pass through two set of valves and two set of pistons (in the first stage and second stage)). It also limits cooling capacity in that only one stage of two is drawing refrigerant into the compressor from the evaporator via the compressor suction port.

Another recent proposal involves isolating the banks of cylinders. Thus, the intake of one bank is at the compressor suction port whereas the intake of another bank is at the compressor economizer port and both discharge to the compressor discharge port. In a two-bank configuration, this would be associated with approximately 1:1 ratios of suction volumetric flow rate to economizer volumetric flow rate. In a three-bank situation wherein two banks draw from the suction port, this would have an approximate 2:1 ratio. Such low ratio of suction flow intake to the economizer port intake is undesirable because it results in low operating efficiency and reduced capacity.

SUMMARY

One aspect of the disclosure involves a compressor comprising: a case defining: a first cylinder bank having a plurality of cylinders; a cylinder head; a suction port; a discharge port; and an economizer port; a plurality of pistons, each individually associated with a respective one of the cylinders; and a crankshaft held by the case for rotation about a crankshaft axis and coupled to the pistons. The first cylinder bank cylinder head is divided into: a first suction chamber; a second suction chamber; and a single discharge chamber. The first cylinder bank first suction chamber is coupled to the suction port. The first cylinder bank second suction chamber is coupled to the economizer port. The first cylinder bank discharge chamber is coupled to the discharge port.

In one or more embodiments of any of the other embodiments, the economizer port is on the first cylinder head.

In one or more embodiments of any of the other embodiments, the economizer port and the discharge port are on the first cylinder head.

In another aspect of the disclosure involves the compressor wherein: the case further defines: a second cylinder bank having a plurality of cylinders; and for the second cylinder bank, a cylinder head. The second cylinder bank cylinder head is divided into: a single suction chamber; and a single discharge chamber. The second cylinder bank suction chamber is coupled to the suction port. The second cylinder bank discharge chamber is coupled to the discharge port.

In one or more embodiments of any of the other embodiments, the first cylinder bank and the second cylinder bank have identical valve plates.

In one or more embodiments of any of the other embodiments, a first cylinder of the first cylinder bank and the cylinders of the second cylinder bank have a first displacement. A second cylinder of the first cylinder bank associated with the second suction chamber has a second displacement, different than the first displacement.

In one or more embodiments of any of the other embodiments, the first cylinder bank first suction chamber and second cylinder bank suction chamber are coupled to the suction port via a sump of the compressor.

In one or more embodiments of any of the other embodiments, the case defines a third cylinder bank.

In one or more embodiments of any of the other embodiments, the case defines a third cylinder bank having a head divided into a single suction chamber and a single discharge chamber.

In one or more embodiments of any of the other embodiments, the third cylinder bank suction chamber is coupled to the suction port; and the third bank discharge chamber is coupled to the discharge port.

In one or more embodiments of any of the other embodiments, the first, second, and third cylinder banks each have exactly two cylinders.

In one or more embodiments of any of the other embodiments, the second cylinder bank is a central cylinder bank. The first cylinder bank discharge chamber and third cylinder bank discharge chamber are coupled to the discharge port via the second cylinder bank discharge chamber.

In one or more embodiments of any of the other embodiments, a method for using the compressor comprises: passing a first flow to the suction port; passing a second flow to the economizer port; splitting the first flow into respective first and second branch flows to the first cylinder bank first suction chamber and the second cylinder bank suction chamber; passing the first branch flow through a first cylinder of the first cylinder bank to the first cylinder bank discharge chamber; passing the second branch flow through the second cylinder bank cylinders in parallel to the first cylinder bank discharge chamber; passing the second flow through a second cylinder of the first cylinder bank to the first cylinder bank discharge chamber; and passing a combined flow from the first cylinder bank discharge chamber and the second cylinder bank discharge chamber out the discharge port.

In one or more embodiments of any of the other embodiments, an electric motor is coupled to the crankshaft to drive rotation of the crankshaft.

In one or more embodiments of any of the other embodiments, a wall of the first cylinder bank cylinder head between the first suction chamber and the second suction chamber intersects a wall between the discharge chamber of the first cylinder bank and the first and second suction chambers of the first cylinder bank.

In one or more embodiments of any of the other embodiments, a portion of the first cylinder bank cylinder head blocks the first cylinder bank second suction chamber from communication with a port in a valve plate of the first cylinder head, the port communicating with a sump of the compressor.

In one or more embodiments of any of the other embodiments, the portion of the first cylinder bank cylinder head is a wall intersecting another wall dividing the first cylinder bank discharge chamber from the first cylinder bank second suction chamber.

In one or more embodiments of any of the other embodiments, a system comprises the compressor and further comprises: a heat rejection heat exchanger; an expansion device; a heat absorption heat exchanger; a refrigerant flowpath from the discharge port sequentially through the heat rejection heat exchanger, expansion device, and heat absorption heat exchanger, returning to the suction port; and an economizer flowpath branching from the refrigerant flowpath to return to the economizer port.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
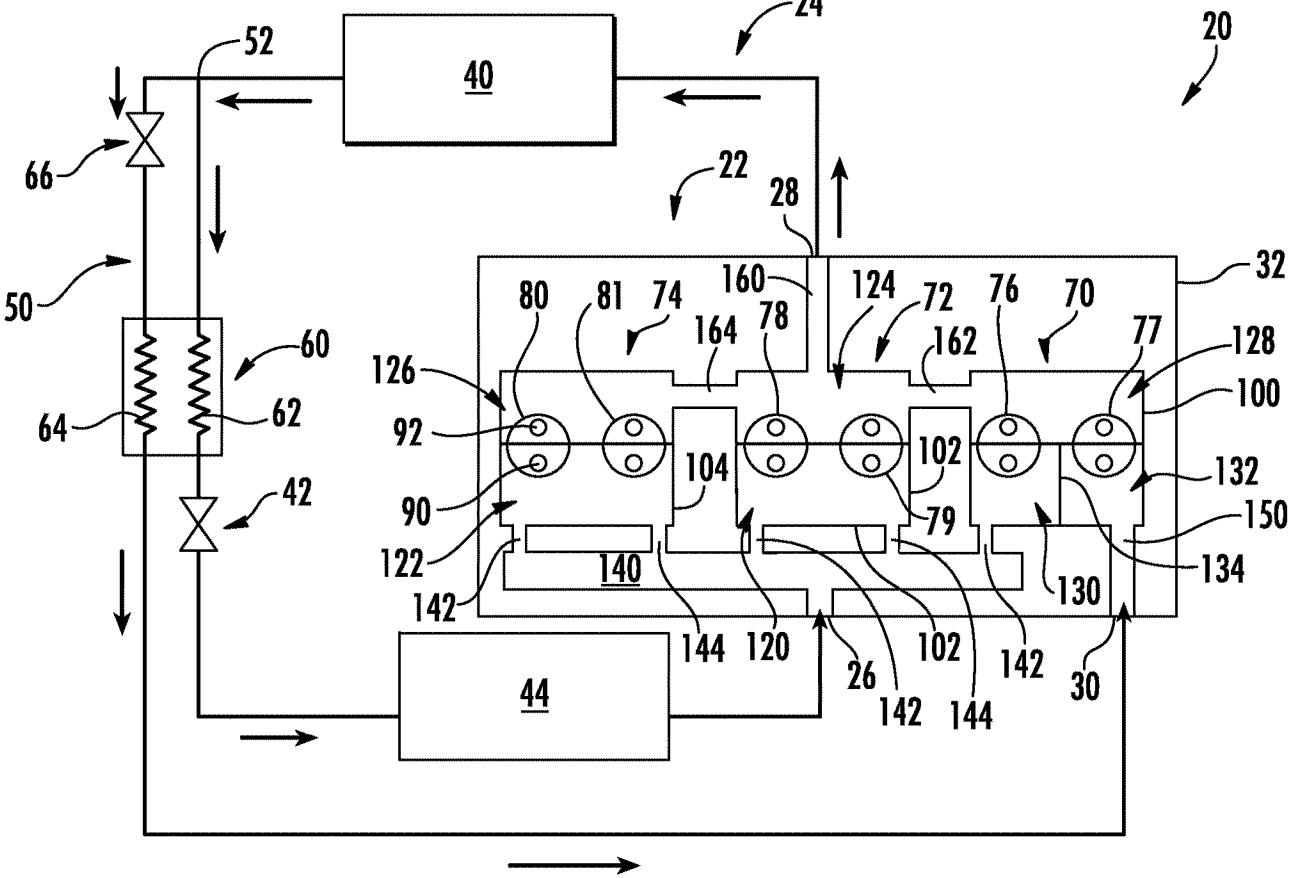
FIG. 1 is a schematic view of a vapor compression system.

FIG. 1 shows a vapor compression system 20 having a compressor 22 for driving a refrigerant flow along a recirculating main flowpath 24 in a normal operational mode. The compressor has a suction port 26 and a discharge port 28. The compressor further comprises an economizer port 30. The compressor has a housing schematically shown as 32 in which the ports are formed.

In the normal operational mode, the main refrigerant flowpath 24 proceeds sequentially from the discharge port 28 downstream through a first heat exchanger 40 (e.g., a condenser or gas cooler acting as a heat rejection heat exchanger), an expansion device 42 (e.g., an electronic expansion valve or the like), and a second heat exchanger 44 (e.g., an evaporator serving as a heat rejection heat exchanger) before returning to the suction port 26.

FIG. 1 further shows a branch flowpath 50 as an economizer flowpath diverging/branching from the main flowpath 24 at a junction 52 and ultimately returning to the economizer port 30. In the exemplary economizer, an economizer heat exchanger 60 places the main flowpath and economizer flowpath downstream of the junction 52 in thermal communication with each other to transfer heat from the main flowpath to the economizer flowpath. To do this, the economizer heat exchanger 60 has a leg 62 along the main refrigerant flowpath and a leg 64 along the economizer flowpath in heat exchange relation with each other. The leg 62 is upstream of the expansion device 42 and the leg 64 is downstream of an expansion device 66 along the economizer flowpath (e.g., an electronic expansion valve or the like). An alternative economizer involves a flash tank economizer.

FIG. 1 schematically shows the exemplary housing 32 as further defining a plurality of cylinders. In the illustrated example, there are three cylinder banks 70, 72, and 74. Each exemplary bank has two cylinders 76, 77; 78, 79; 80, 81. Each cylinder has one or more suction or intake ports 90 and discharge or outlet ports 92 (e.g., compressor internal ports such as in a valve plate in addition to the overall compressor suction port 26 and discharge port 28). Respective heads 100, 102, 104 of the banks separate one or more discharge chambers communicating with the discharge ports from one or more suction or intake chambers communicating with the suction ports. In a conventional manner, the second and third heads each define a single suction chamber 120, 122 and a single discharge chamber 124, 126. In a baseline compressor from which the present compressor is reengineered, the first bank may have a similar arrangement. The exemplary compressor first bank 70 head 100 preserves its baseline discharge chamber 128 but divides what would have been a single suction chamber into a first suction chamber 130 communicating with the suction port of the first cylinder 76 and a second suction chamber 132 communicating with the suction port of the second cylinder 77. This may be achieved by adding a dividing wall 134 across what would have been the single suction chamber of the baseline head. As is discussed further below, this configuration allows the first bank second cylinder to be fed via the economizer port whereas the remaining cylinders of the compressor are fed from the suction port. Thus, the second cylinder suction chamber 132 may be referred to as an economizer chamber. This allows an approximate 5:1 ratio of suction flow to economizer flow. This may be contrasted with a situation where an entire bank (of a three-bank compressor) is fed from the economizer port thus having a ratio of 2:1.

In the exemplary baseline compressor, the compressor suction port 26 communicates with a sump 140 and via the sump to the suction chambers. This communication may be provided by one or more passageways extending outward through the cylinder case (e.g., that defines the bores of the cylinders). In this example, there are two passageways 142, 144, one at either end of the bank. In the reengineering of the first bank, the second passageway 144 is eliminated (e.g., as is discussed below, one portion of that passageway may be eliminated, leaving other portions moot). That passageway is replaced with a passageway 150 that may extend through the cylinder case or directly into the head from the economizer port 30.

In the exemplary baseline compressor, the compressor discharge port 28 is coupled via a passageway 160 to the second bank discharge chamber 126. The passageway 160 may simply be within the head 102. The first bank discharge chamber 128 and third bank discharge chamber 176 are coupled via respective passageways 162, 164 (crossover passageways) to the second bank discharge chamber 124.

An exemplary layout of the compressor is a W layout wherein the three banks are spaced at intervals circumferentially about a crank axis with the cylinders of each bank being spaced axially and facing generally radially outward. The exemplary arrangement places the bank 126 in the center of a close grouping of the three banks.

Figure 2:
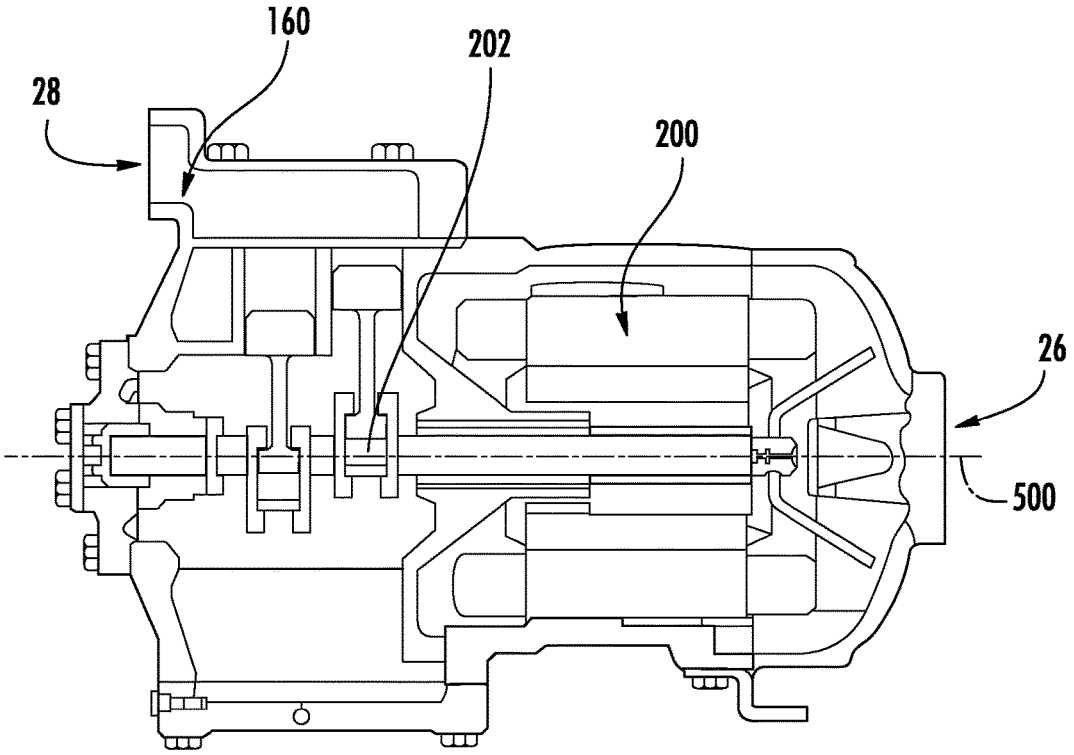
FIG. 2 is a partially schematic vertical sectional view of a compressor.

FIG. 2 shows the compressor having a motor 200 driving a crankshaft 202 held by the case for rotation about a central longitudinal axis 500. The exemplary view is a simplified vertical sectional view through the second cylinder bank.

Figure 3:
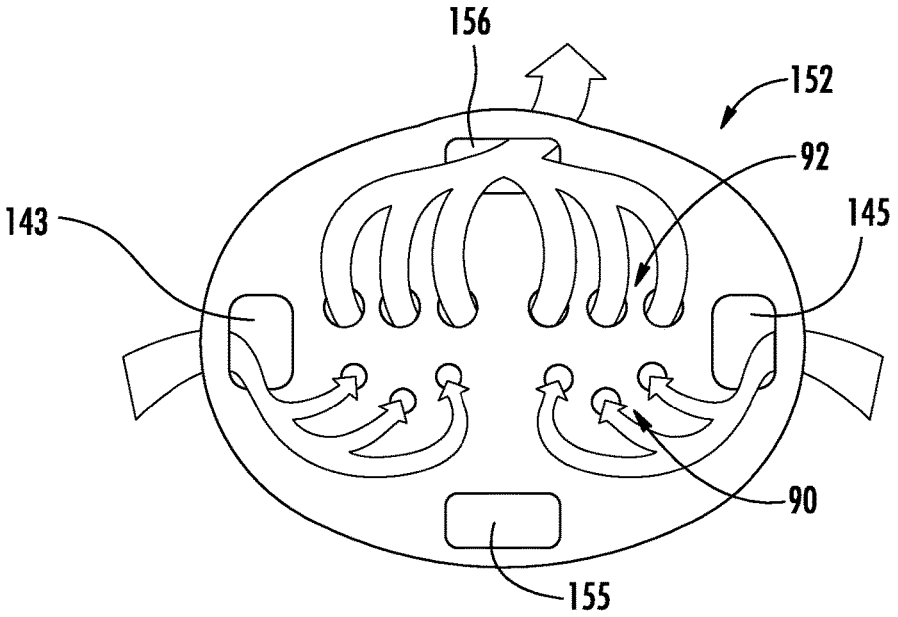
FIG. 3 (PRIOR ART)
FIG. 3 is a plan view of a prior art valve plate.
Figure 4:
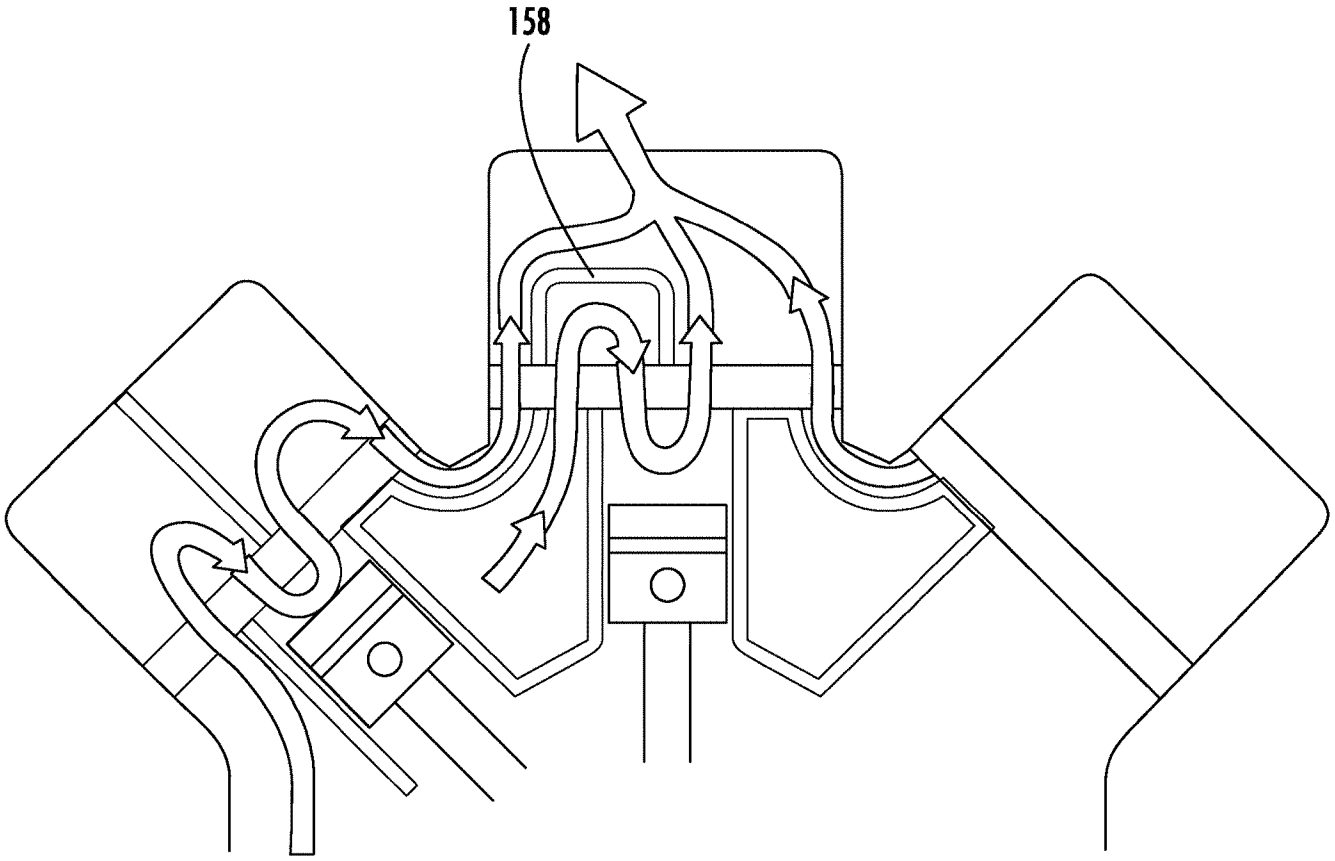
FIG. 4 (PRIOR ART)
FIG. 4 is a partial transverse schematic sectional view showing cross-over flow in a three-bank compressor.

FIG. 3 shows a valve plate 152 that intervenes between the cylinder case and head of one of the cylinder banks. For each of the two exemplary cylinders, the suction port comprises three openings and the discharge port comprises three openings. The openings may be sealed by reed valves (not shown). At opposite longitudinal ends, there are ports 143, 145 along the respective passageways 142 and 144 that may serve as suction gas inlets passing suction gas outward from the sump into the suction chamber. At lateral ends, there may be ports 155 that serve a discharge function. The port 156, depending on which cylinder is involved, may serve a suction function or a cross-over function. FIG. 4 shows the two lateral ports of the second central bank as being cross-over ports. Because one of these ports is alongside the suction chamber, a dividing cover 158 is placed within the suction chamber to isolate the suction flow for the second bank.

Figure 5:
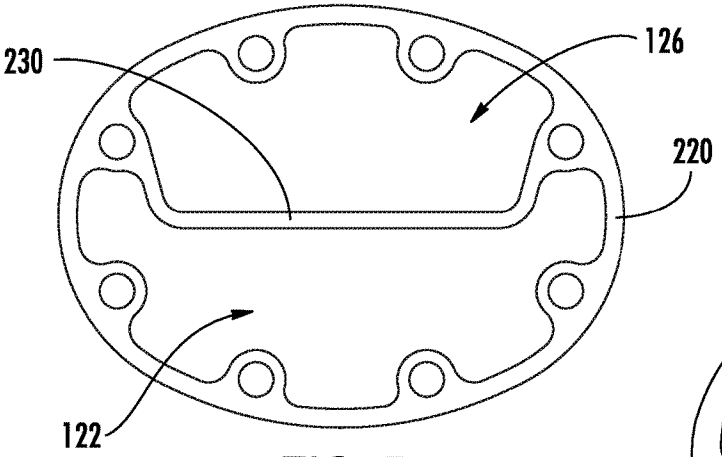
FIG. 5 (PRIOR ART)
FIG. 5 is a plan view of a gasket for a prior art head.
Figure 6:
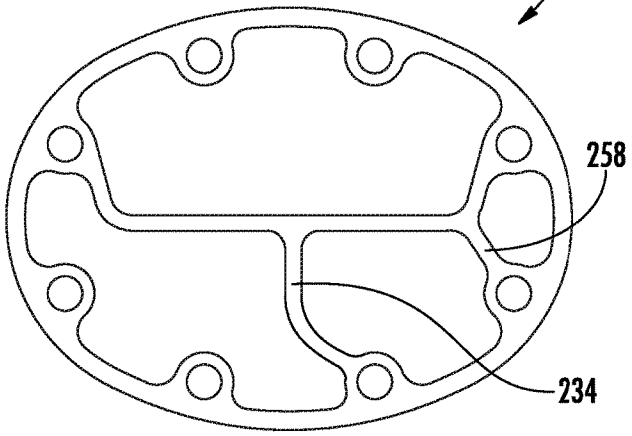
FIG. 6 is a plan view of a gasket for an economized head.

FIG. 5 shows a gasket for a head of the two outboard/lateral banks of the baseline compressor. FIG. 6 shows a revised gasket for a revised head of FIG. 7. In the exemplary three-bank compressor with discharge from the center bank, the baseline gasket represents a configuration usable on the two outboard/lateral banks. The gasket also provides a partial schematic of the head layout of the baseline compressor (with various legs of the gasket material corresponding to walls of the head and various gaps between legs corresponding to various chambers or passageways). The gasket has a perimeter band 220 corresponding to a sidewall 240 of the head. The discharge chamber 124, 126 is separated from the suction chamber 120, 122 via a leg 230 of the gasket and corresponding wall 250 of the head. The baseline suction chamber includes portions that register with the two suction gas inlets 143, 145 (and 155 in case of the outboard/lateral bank) of FIG. 3; thus the gasket has open areas. FIG. 6 shows a modified version of the gasket of FIG. 5 wherein the subject cylinder bank is converted into an economized bank (e.g., the first bank in the example above).

In order to form the exemplary present first bank cylinder head 100, the additional wall 134 and associated gasket leg 234 (FIG. 6) are added joining the dividing wall 250 (and leg 230) to the sidewall 240 (and perimeter band 220). Additionally, communication of the second cylinder 77 suction port with the adjacent suction gas inlet must be blocked. This may be done in one or more of several ways. First, the adjacent suction gas inlet 145 may be removed in a redesign of the valve plate. Second, the head may simply be formed (e.g., cast) with a surface 260 (FIG. 7) to block communication of the suction chamber 132 with the adjacent suction gas inlet 145. FIG. 6 shows an additional gasket leg 258 sealing this surface.

Figure 7:
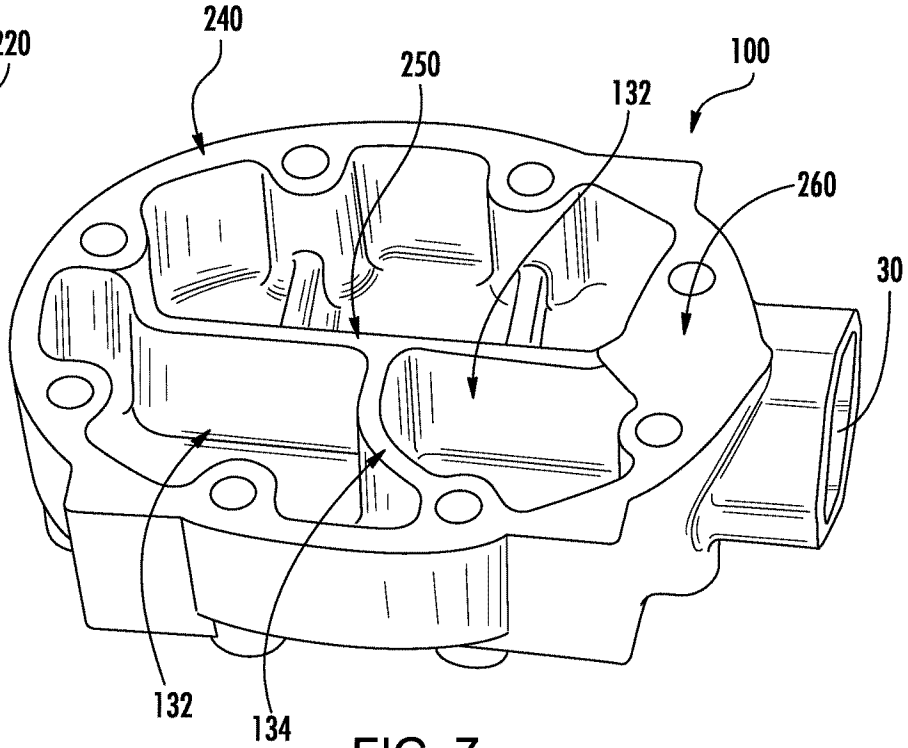
FIG. 7 is an isometric view of the economized head.

FIG. 7 shows the head casting with the economizer port 30 as a portion of the casting communicating with the suction chamber 132 (which serves as an economizer chamber).

Figure 8:
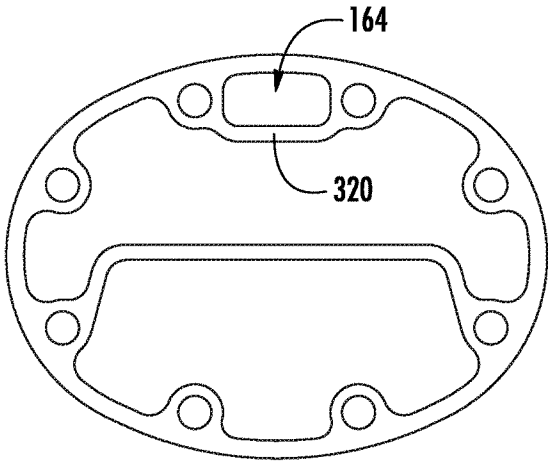
FIG. 8 (PRIOR ART)
FIG. 8 is a plan underside view of a gasket for a second prior art head.

An alternative modification could involve modifying the baseline center bank to become the economized bank. FIG. 8 shows a baseline gasket for the baseline center bank. Generally similar to the gasket of FIG. 5, it also includes a portion 320 representing a wall of the head surrounding a discharge flow crossover port/passage 162 or 164.

Figure 9:
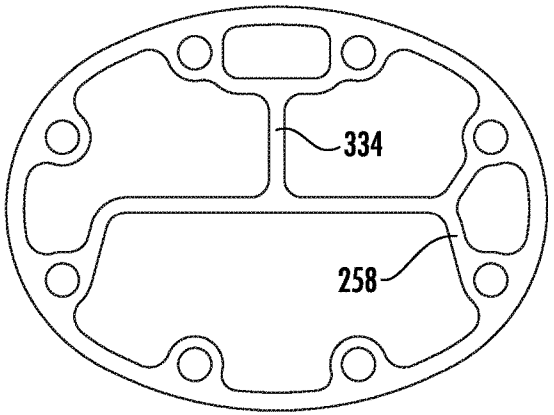
FIG. 9 is a plan underside view of a gasket for a second economized head.

FIG. 9 shows a modified gasket representative of a similar modification relative to FIG. 8 as FIG. 6 is to FIG. 5. Gasket leg 334 and head wall 336 may be similar to leg 234 and wall 134.

Figure 10:
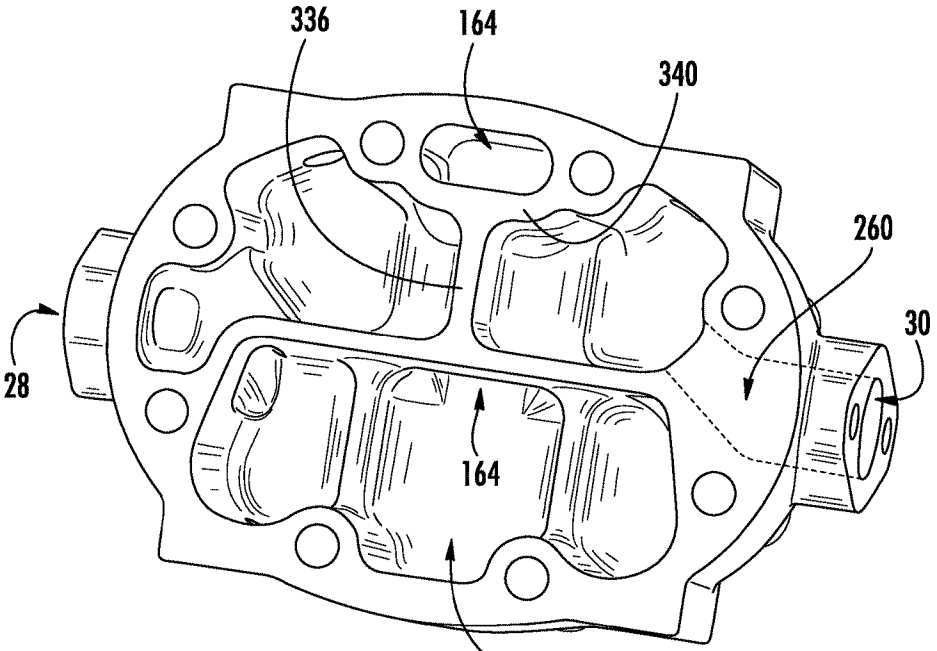
FIG. 10 is an isometric view of the second economized head.

FIG. 10 shows the associated modified center bank head. In the baseline system, the two lateral bank heads have no ports and the center bank head has the discharge port. Whereas the first modification of FIG. 7 modifies one of the lateral bank heads to have an economizer port 30, the second modification of FIG. 10 instead modifies the center bank head to have the economizer port 30 and discharge port 28.

Various asymmetries may be introduced in reengineering a configuration of a non-economized compressor to an economized compressor as discussed above or remanufacturing an existing non-economized compressor to become economized. The displacement of the cylinder associated with the economizer flow may be altered relative to the other cylinders (e.g., for example the cylinder associated with the economizer flow may have a smaller diameter than other cylinders). To accommodate change in bearing loading, connecting rod wrist pin bearings or other bearings may be altered for economized compressor. For example, the modified compressor could have a needle bearing instead of a fluid film bearing for a connecting rod wrist pin bearing for an economized cylinder The compressor and system may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A compressor (22) comprising:

a case (32) defining:

a first cylinder bank (70) having a plurality of cylinders (76, 77) and a cylinder head (100);

a suction port (26);

a discharge port (28); and an economizer port (30); and a plurality of pistons, each individually associated with a respective one of the cylinders; and a crankshaft (202) held by the case for rotation about a crankshaft axis and coupled to the pistons, wherein:

the first cylinder bank cylinder head is divided into: a first suction chamber (130); a second suction chamber (132); and a single discharge chamber (128);

the first cylinder bank first suction chamber is coupled to the suction port;

the first cylinder bank second suction chamber is coupled to the economizer port; and the first cylinder bank discharge chamber is coupled to the discharge port.

2. The compressor of claim 1 wherein:

the economizer port is on the first cylinder bank cylinder head.

3. The compressor of claim 1 wherein:
the economizer port and the discharge port are on the first cylinder bank cylinder head.

4. The compressor of claim 1 wherein:
the case (32) further defines:
a second cylinder bank (72) having a plurality of cylinders (78, 79); and
for the second cylinder bank, a cylinder head (102);
the second cylinder bank cylinder head is divided into: a single suction chamber (120); and a single discharge chamber (124);
the second cylinder bank suction chamber is coupled to the suction port; and
the second cylinder bank discharge chamber is coupled to the discharge port.

5. The compressor of claim 4 wherein:
the first cylinder bank and the second cylinder bank have identical valve plates.

6. The compressor of claim 4 wherein:
a first cylinder of the first cylinder bank and the cylinders of the second cylinder bank have a first displacement; and
a second cylinder of the first cylinder bank associated with the second suction chamber has a second displacement, different than the first displacement.

7. The compressor of claim 4 wherein:
the first cylinder bank first suction chamber and second cylinder bank suction chamber are coupled to the suction port via a sump (140) of the compressor.

8. The compressor of claim 4 wherein:
the case defines a third cylinder bank (74).

9. The compressor of claim 4 wherein:
the case defines a third cylinder bank (74) having a head (104) divided into a single suction chamber (122) and a single discharge chamber (126).

10. The compressor of claim 9 wherein:
the third cylinder bank suction chamber is coupled to the suction port; and
the third cylinder bank discharge chamber is coupled to the discharge port.

11. The compressor of claim 10 wherein:
the first, second, and third cylinder banks each have exactly two cylinders.

12. The compressor of claim 10 wherein:
the second cylinder bank is a central cylinder bank; and
the first cylinder bank discharge chamber and third cylinder bank discharge chamber are coupled to the discharge port via the second cylinder bank discharge chamber.

13. A method for using the compressor of claim 4, the method comprising:
passing a first flow to the suction port;
passing a second flow to the economizer port;
splitting the first flow into respective first and second branch flows to the first cylinder bank first suction chamber and the second cylinder bank suction chamber
passing the first branch flow through a first cylinder of the first cylinder bank to the first cylinder bank discharge chamber;
passing the second branch flow through the second cylinder bank cylinders in parallel to the first cylinder bank discharge chamber;
passing the second flow through a second cylinder of the first cylinder bank to the first cylinder bank discharge chamber; and
passing a combined flow from the first cylinder bank discharge chamber and the second cylinder bank discharge chamber out the discharge port.

14. The compressor of claim 1 further comprising:
an electric motor (200) coupled to the crankshaft to drive rotation of the crankshaft.

15. The compressor of claim 1 wherein:
a wall (134) of the first cylinder bank cylinder head between the first suction chamber and the second suction chamber intersects a wall (250) between the discharge chamber of the first cylinder bank and the first and second suction chambers of the first cylinder bank.

16. The compressor of claim 1 wherein:
a portion (260) of the first cylinder bank cylinder head blocks the first cylinder bank second suction chamber from communication with a port in a valve plate of the first cylinder head, the port communicating with a sump of the compressor.

17. The compressor of claim 16 wherein:
the portion (260) of the first cylinder bank cylinder head is a wall intersecting another wall (250) dividing the first cylinder bank discharge chamber from the first cylinder bank second suction chamber.

18. A system comprising the compressor of claim 1 and further comprising:
a heat rejection heat exchanger (40);
an expansion device (42);
a heat absorption heat exchanger (44);
a refrigerant flowpath (24) from the discharge port sequentially through the heat rejection heat exchanger, expansion device, and heat absorption heat exchanger, returning to the suction port; and
an economizer flowpath (50) branching from the refrigerant flowpath to return to the economizer port.

* * * * *